US008500355B2

(12) United States Patent
Liu

(10) Patent No.: US 8,500,355 B2
(45) Date of Patent: Aug. 6, 2013

(54) LIQUID DISPENSING MASSAGE DEVICE WITH SWITCH LOCK

(75) Inventor: Li-Mei Liu, Guang Dong Province (TW)

(73) Assignee: Allen & Thomas Cosmetic Accessories Co., Ltd., Zhuhai (CN)

( * ) Notice: Subject to any disclaimer, the term of this patent is extended or adjusted under 35 U.S.C. 154(b) by 106 days.

(21) Appl. No.: 13/276,665

(22) Filed: Oct. 19, 2011

(65) Prior Publication Data

US 2013/0101340 A1 Apr. 25, 2013

(51) Int. Cl.
*B05C 17/02* (2006.01)
*A61H 1/00* (2006.01)

(52) U.S. Cl.
USPC ..... 401/209; 401/208; 401/213; 401/216; 601/46

(58) Field of Classification Search
USPC ..... 401/209, 216; 222/196, 196.1; 601/46
See application file for complete search history.

(56) References Cited

U.S. PATENT DOCUMENTS

| | | | | |
|---|---|---|---|---|
| 2006/0287616 | A1* | 12/2006 | Nan | 601/17 |
| 2010/0251505 | A1* | 10/2010 | Vrdoljak et al. | 15/320 |
| 2010/0329771 | A1* | 12/2010 | Zhang | 401/213 |
| 2011/0091264 | A1* | 4/2011 | Zhang | 401/139 |
| 2011/0091265 | A1* | 4/2011 | Zhang | 401/195 |
| 2011/0243642 | A1* | 10/2011 | Zhang | 401/213 |
| 2012/0207532 | A1* | 8/2012 | Ho | 401/209 |

* cited by examiner

*Primary Examiner* — David Walczak
*Assistant Examiner* — Joshua Wiljanen

(57) ABSTRACT

A liquid dispensing massage device is provided with a liquid container having an externally threaded neck; a dispensing assembly comprising a retaining ring, a seal, a rotatable liquid dispensing outlet, a spring biased sliding plunger defining an axial channel therethrough; a cap; a vibration shell assembly; a vibration assembly in the shell and comprising a battery powered DC motor; and a switch. In a closed position of the device, the switch is locked. In an open position of the device, the switch is unlocked and read to move, and a fluid passage is not blocked by the plunger so that a manual movement of the switch activates the DC motor for generating vibration.

8 Claims, 10 Drawing Sheets

LIQUID DISPENSING MASSAGE DEVICE WITH SWITCH LOCK

BACKGROUND OF THE INVENTION

1. Field of the Invention

The invention relates to vibration type liquid dispensers and more particularly to a liquid dispensing massage device having an arrangement for locking a switch when the device is in a closed inoperative position so as to prevent the device from being activated due to an inadvertent movement of the switch.

2. Description of Related Art

There is a conventional type of liquid dispensing massage device commercially available. Although it enjoyed wide use due to convenience in use and portability, it has presented some problems. For example, switch of the conventional liquid dispensing massage device may be inadvertently turned on due to contact when it is placed in a pocket or bag. Further, battery of the conventional liquid dispensing massage device may quickly consume if a user did not notice the unintended activation of the switch and turned it off immediately. Thus, the user may find the conventional liquid dispensing massage device being inoperable due to battery low when such needs arises. Battery replacement is thus required. To the worse, electric motor of the conventional liquid dispensing massage device may malfunction due to a long period of continuous use. Thus, the need for improvement still exists.

SUMMARY OF THE INVENTION

It is therefore one object of the invention to provide a liquid dispensing massage device having an arrangement for locking a switch when the device is in a closed, inoperative position so as to prevent the device from being activated due to an inadvertent movement of the switch.

For achieving above and other objects, the invention provides a liquid dispensing massage device comprising a container for containing a quantity of liquid and including an externally threaded neck; a dispensing assembly comprising a retaining ring, a seal, a rotatable liquid dispensing outlet, a hollow sliding plunger defining an axial channel therethrough, the plunger including an annular protrusion on an outer surface proximate one end, the plunger being secured to the retaining ring together, a sleeve put on a portion of the plunger and including a passage at one end distal the liquid dispensing outlet, an externally extending annular flange at the other end, an internally extending annular flange adjacent the externally extending annular flange, and a space defined between and by the sleeve and the protrusion, and a biasing member put on the plunger and disposed in the space to urge against both the plunger and the sleeve toward opposite directions; a cap comprising an annular projection on an inner surface adjacent its opening, and a peg on the underside of its top wherein the dispensing assembly is covered by the cap and the peg is engaged with the liquid dispensing outlet when the liquid dispensing massage device is closed; a vibration shell assembly comprising a cup with the sleeve fastened therein and around an opening of the cup, a cylindrical shell, and a curved cover wherein the cup includes a disc-shaped base at one end fixedly secured to the other end of the shell, and the shell includes internal threads proximate one end, the internal threads being capable of threadedly securing to the externally threaded neck for fastening the shell and the container together, a circumferential opening with the cover complimentarily hingedly disposed thereon, and a passageway so that the liquid in the container is capable of flowing to the space via the passageway and the passage; a vibration assembly disposed in the shell and comprising a DC motor, a battery, a motor seat with the DC motor mounted thereon, and a battery seat wherein the DC motor is electrically connected to the battery seat; and a switch assembly comprising a first contact electrically connected to the battery, a second contact electrically connected to the DC motor, a switch including a curved base member, an outer knurled member spaced from the base member, and a tunnel defined by and between the base member and the knurled member, and an elongated sliding member slidably disposed through the tunnel and including two inclined shoulders, a narrow activation section proximate one end, and a stop section at the other end, wherein in a closed position of the liquid dispensing massage device, the cap is put on the cup, the shoulders are lockingly engaged with the tunnel to fasten both the sliding member and the switch, the biasing member is compressed to store an elastic force, the passage is blocked by the plunger, the switch is in a locked, off position, and the first contact is disengaged from the second contact to electrically disconnect the battery from the DC motor; and wherein in an open position of the liquid dispensing massage device, the cap is detached from the cup the shoulders are disengaged from the tunnel to unfasten both the sliding member and the switch, the biasing member is expanded to release the stored elastic force to push the protrusion until the protrusion is stopped by the internally extending annular flange adjacent, the passage is not blocked by the plunger, and the switch is in a moveable position so that a manual movement of the switch causes the base member to press the first contact which in turn engages with the second contact to electrically connect the battery to the DC motor.

The above and other objects, features and advantages of the invention will become apparent from the following detailed description taken with the accompanying drawings.

DETAILED DESCRIPTION OF THE INVENTION

Figure 1:
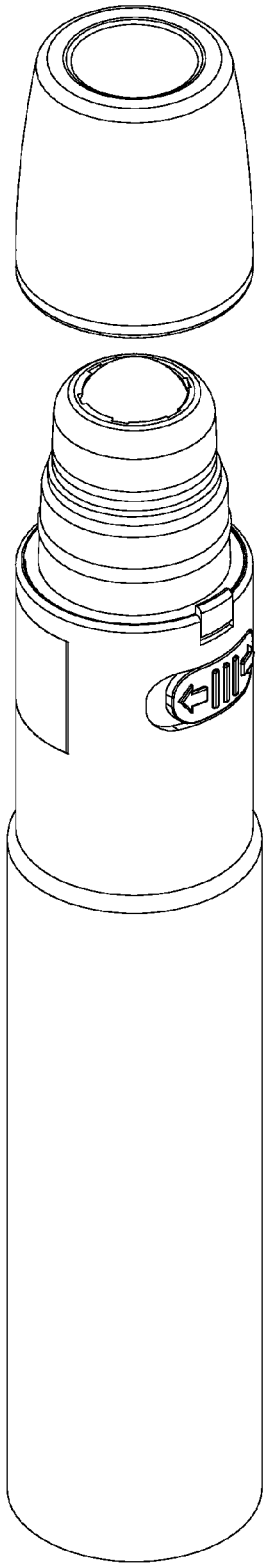
FIG. 1 is a perspective view of a liquid dispensing massage device according to the invention with cap disengaged.
Figure 2:
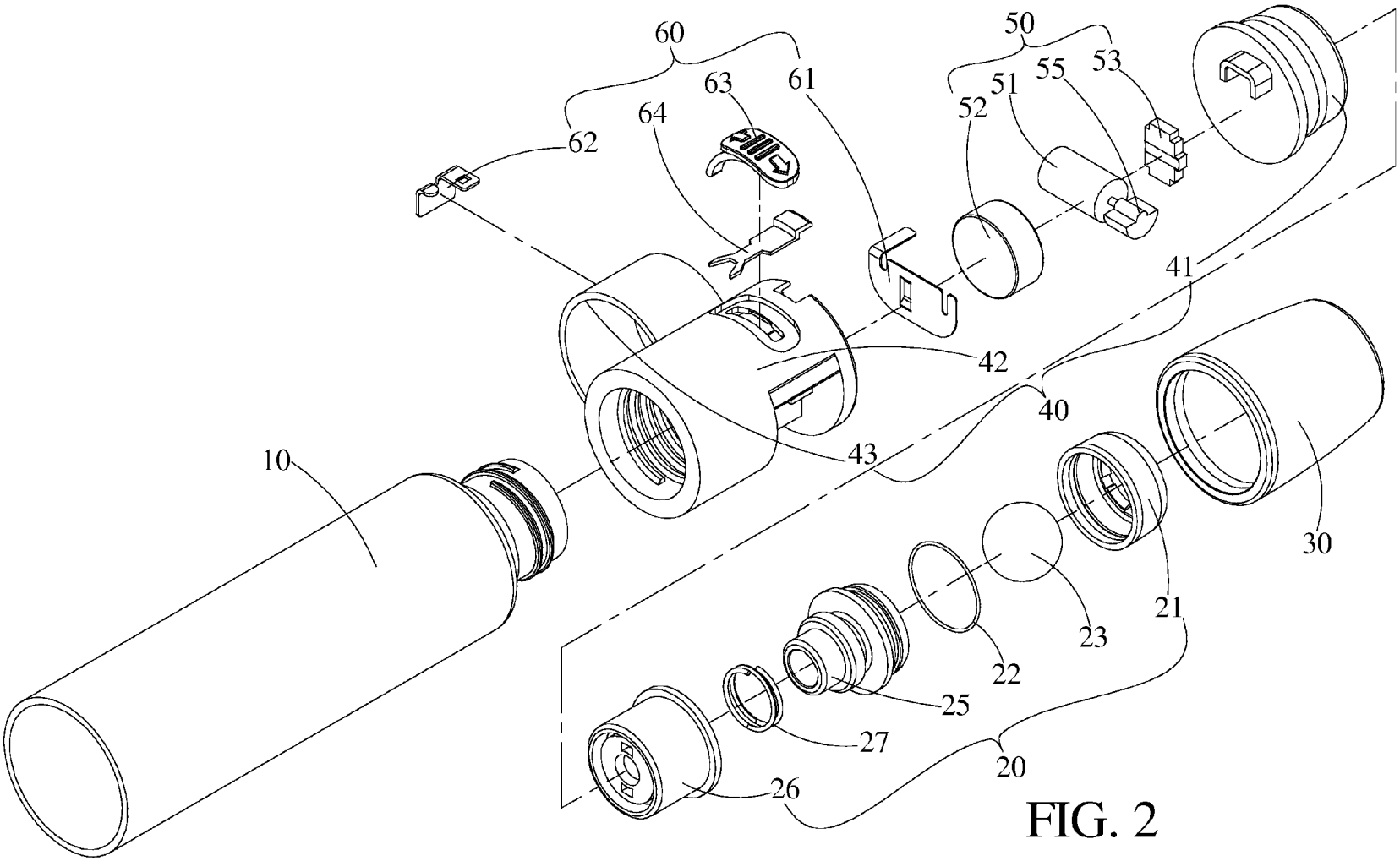
FIG. 2 is an exploded view of the liquid dispensing massage device.
Figure 3:
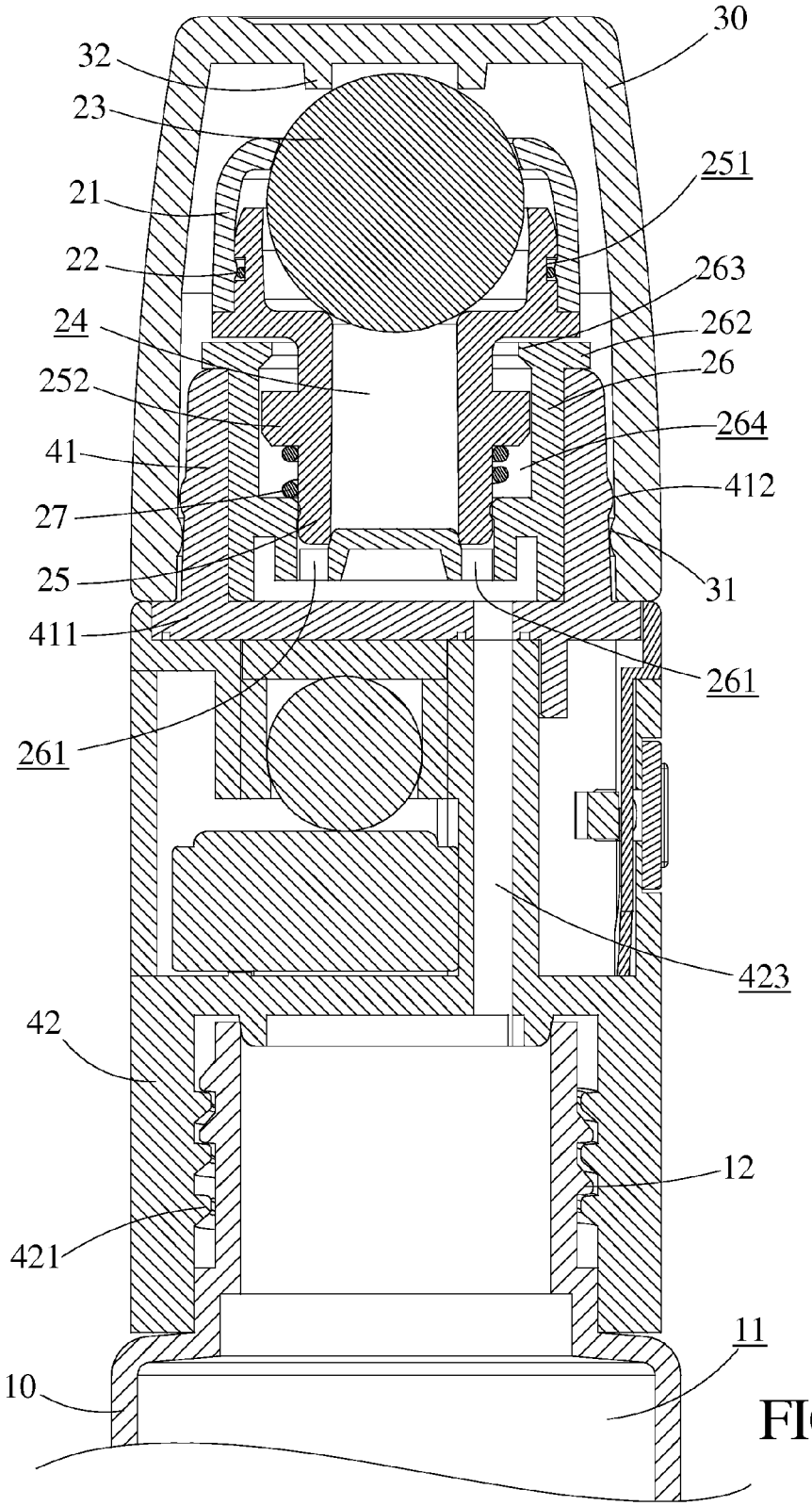
FIG. 3 is a longitudinal sectional view of the upper portion of the assembled liquid dispensing massage device.
Figure 4:
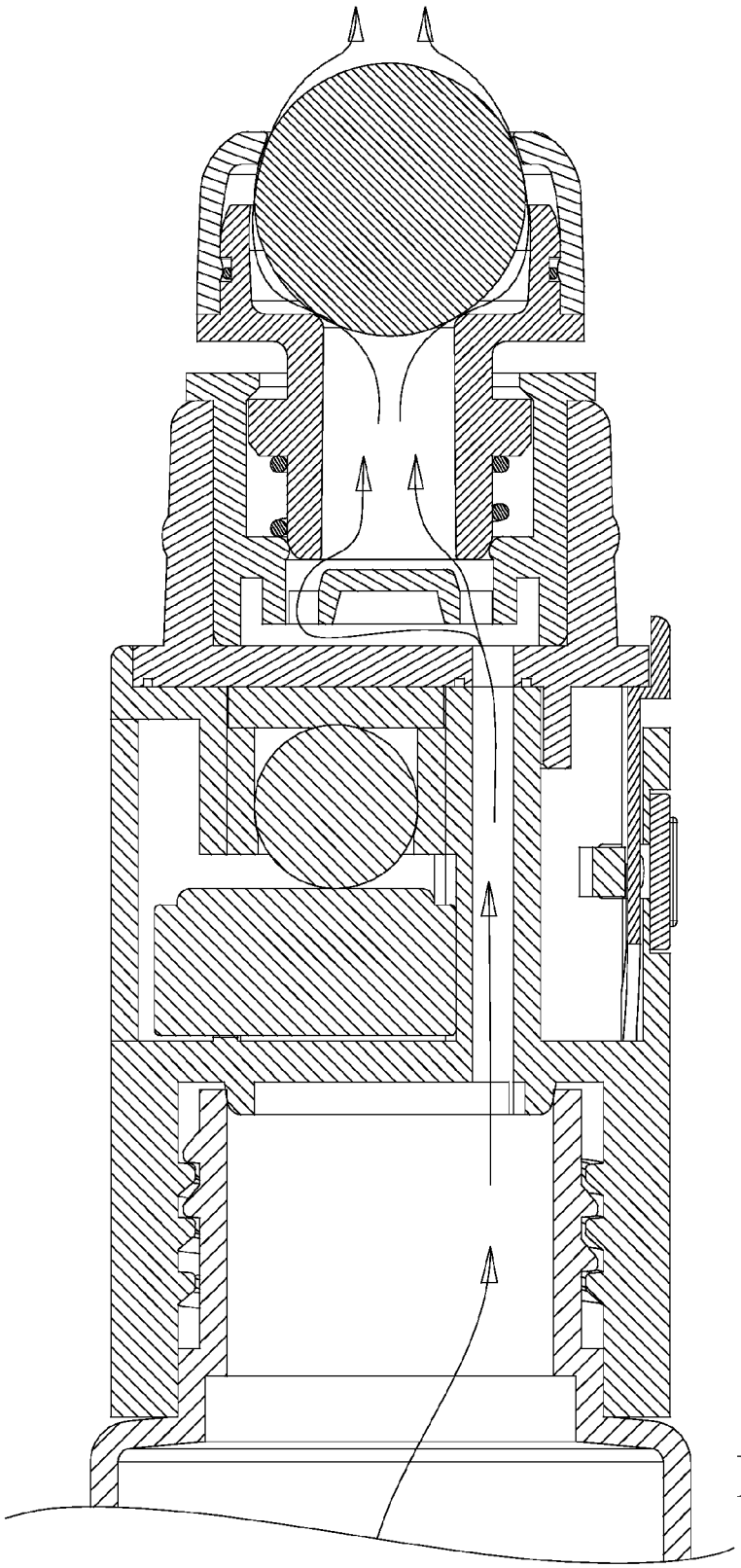
FIG. 4 is a view similar to FIG. 3 with the cap removed so that fluid may flow out of the container via the ball for dispensing.
Figure 5:
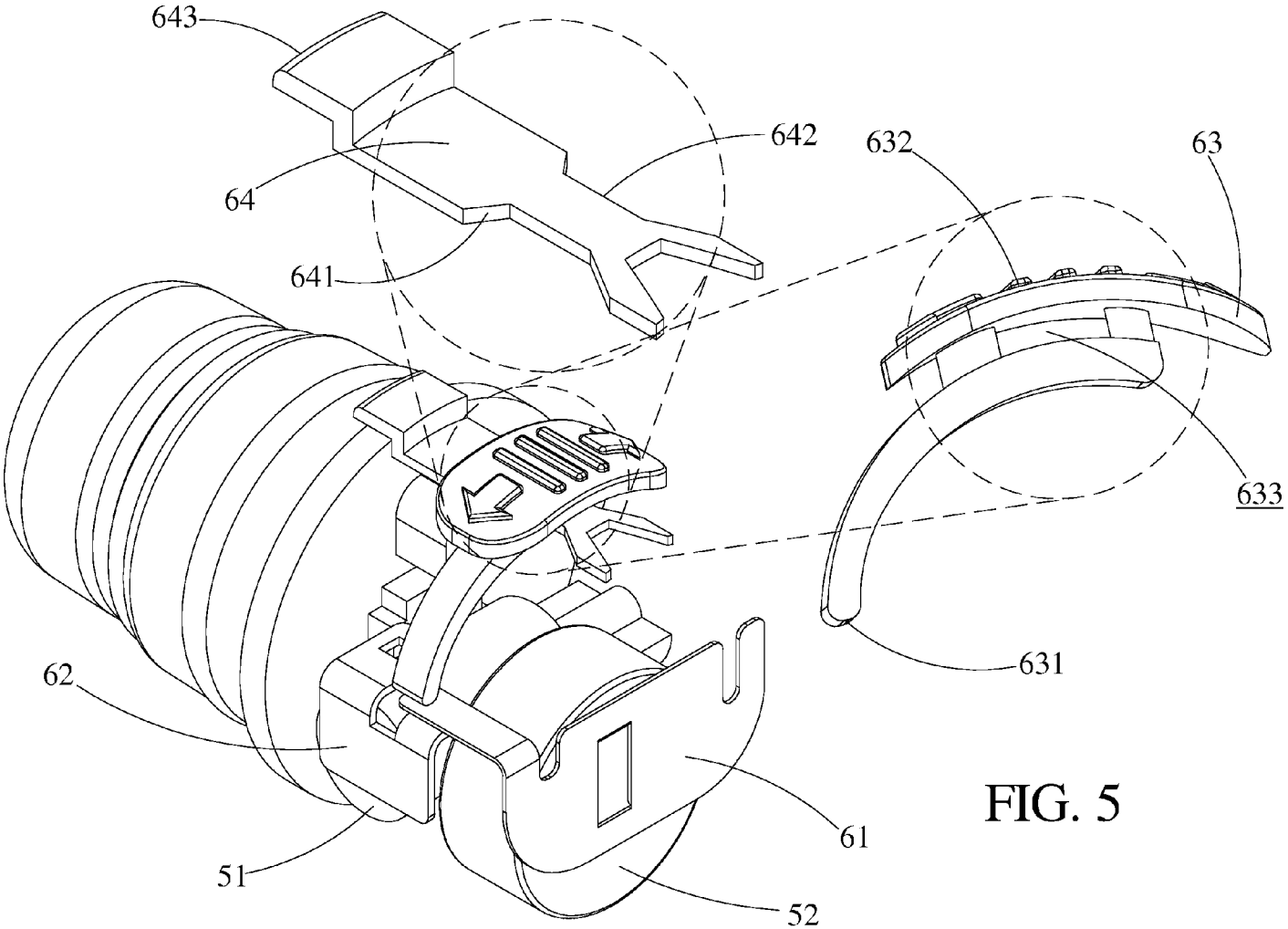
FIG. 5 is a perspective view of the vibration assembly and the switch assembly.

Referring to FIGS. 1 to 10, a liquid dispensing massage device in accordance with the invention comprises the following components as discussed in detail below.

A container 10 comprises a reservoir 11 for storing a quantity of liquid (e.g., lotion) and an externally threaded neck 12 on the mouth of f the container 10. A hollow dispensing assembly 20 comprises a retaining ring 21, an O-ring 22 as seal, a ball 23 as liquid dispensing outlet, a hollow sliding plunger 25 defining an axial channel 24 therethrough and including an annular groove 251 on an outer surface, the groove 251 being proximate the other end of the plunger 25 with the O-ring 22 provided therein, and an annular protrusion 252 on the outer surface proximate one end, the plunger 25 being secured to the retaining ring 21 together with the ball 23 rotatably disposed in an opening of the retaining ring 21 and supported by the plunger 25, a sleeve 26 put on a portion of the plunger 25 and including a passage 261 at one end distal the ball 23, an externally extending annular flange 262 at the other end, an internally extending annular flange 263 adjacent the externally extending annular flange 262, and a space 264 defined between and by the sleeve 26 and the protrusion 252, and a torsion spring 27 put on the plunger 25 (i.e., in the space 264) to urge against both the plunger 25 and the sleeve 26 in opposite directions.

A cap 30 comprises an annular projection 31 on an inner surface adjacent its opening, and an annular peg 32 on the underside of its flat top, the peg 32 being engaged with the ball 23 when the liquid dispensing massage device is closed.

A vibration shell assembly 40 comprises a cup 41, a cylindrical shell 42, and a curved cover 43 hingedly secured to the shell 42. The cup 41 includes a disc-shaped base 411 at one end fixedly secured to the other end of the shell 42, and an annular riser 412 on an outer surface. The riser 412 can be complimentarily retained by the projection 31 to lockingly secure the cup 41 to the cap 30 when the cap 30 is put on the cup 41 by snapping. The shell 42 includes internal threads 421 proximate one end, the internal threads 421 being adapted to threadedly secure to the externally threaded neck 12 for fastening the shell 42 and the container 10 together, a circumferential opening 422 with the cover 43 complimentarily hingedly provided thereon, and a passageway 423 so that fluid may flow from the reservoir 11 to the channel 24 and further via the passageway 423 and the passage 261 in operation as detailed later (see FIG. 4).

Figure 6:
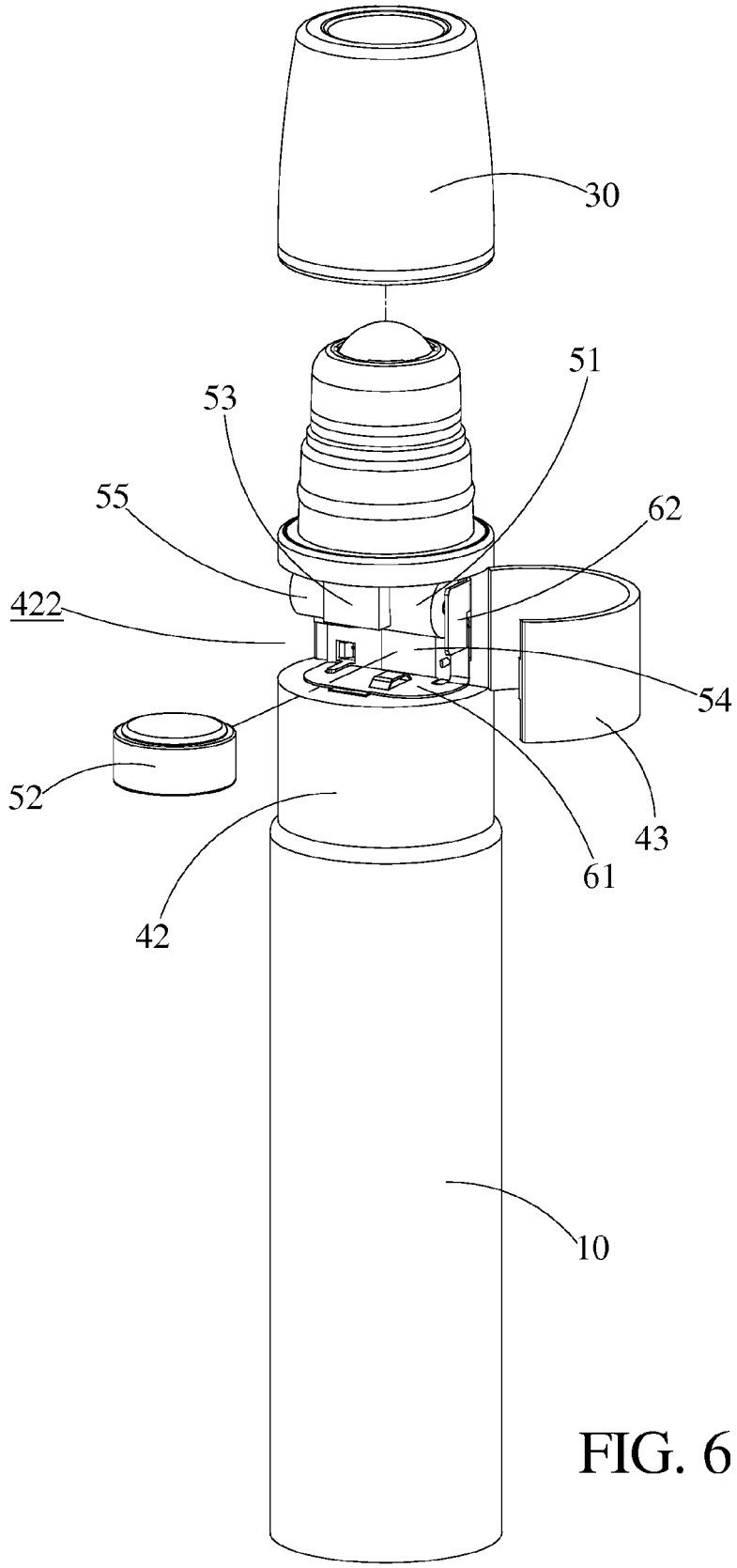
FIG. 6 is a perspective view of the liquid dispensing massage device showing a cell replacement operation with the cap disengaged and the hinged cover open.

A vibration assembly 50 is provided in the shell 42 and comprises a DC (direct current) motor 51, a battery 52, a motor seat 53 with the DC motor 51 provided thereon, a battery seat 54 with the battery 52 mounted thereon, and an eccentric block 55 rotatably driven by the DC motor 51 for generating vibration. The DC motor 51 is electrically connected to the battery seat 54. A user may open the cover 43 to replace the consumed battery 52 with a new one if such need arises (FIG. 6).

A switch assembly 60 comprises a first contact 61 electrically connected to a negative terminal of the battery 52, a second contact 62 electrically connected to a negative terminal of the DC motor 51, a switch 63 including a curved base member 631, an outer knurled member 632 spaced from the base member 631, and a tunnel 633 defined by and between the base member 631 and the knurled member 632, and an elongated sliding member 64 slidably disposed through the tunnel 633 and including two inclined shoulders 641, a narrow activation section 642 proximate one end, and a stop section 643 at the other end.

Figure 7:
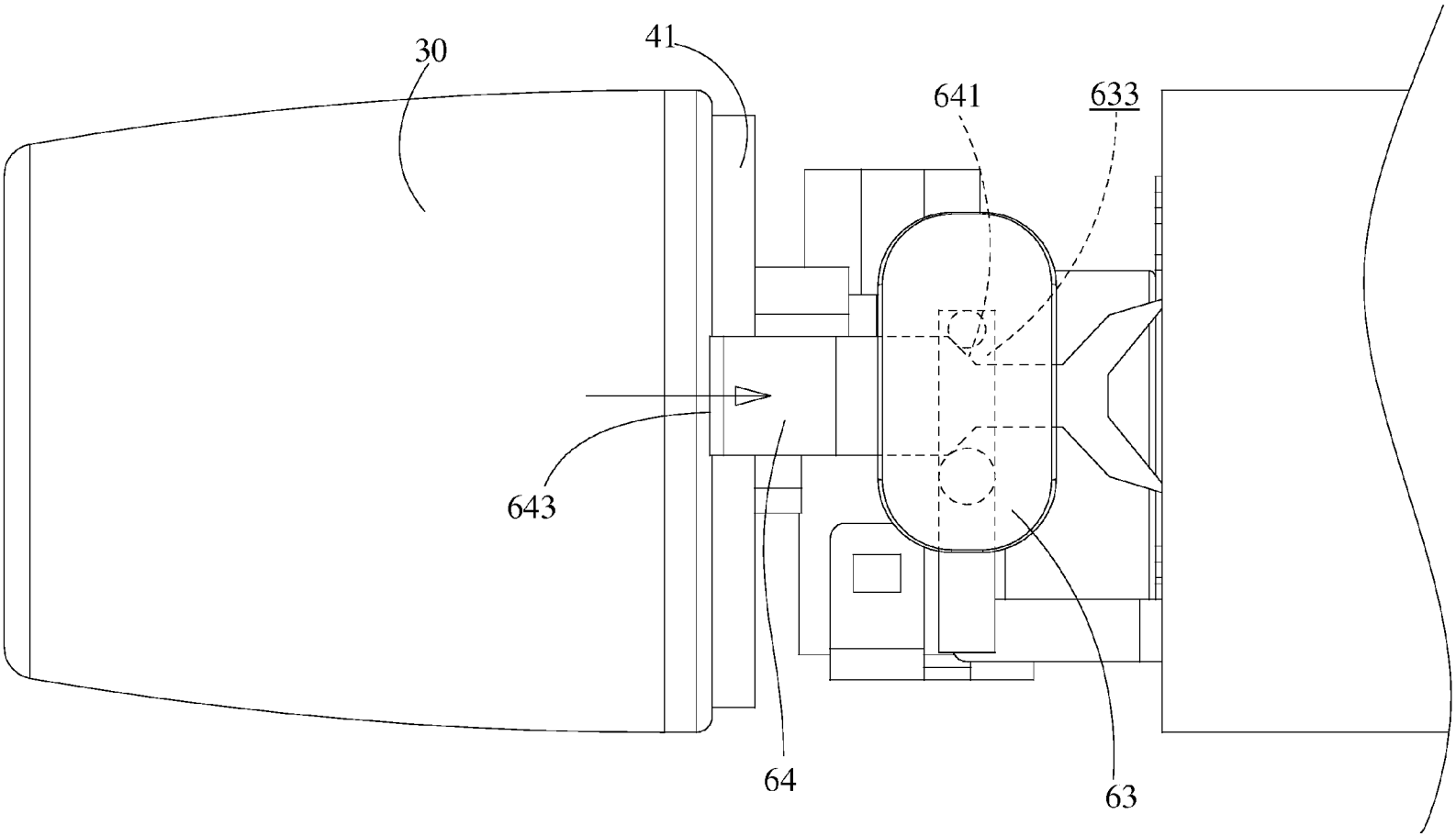
FIG. 7 is a top plan view of FIG. 5 showing the switch being locked in an off position.

The sliding member 64 (i.e., stop section 643) cannot be moved because the shoulders 641 are lockingly engaged with the tunnel 633 when the cap 30 is put on the cup 41 by snapping as shown in FIG. 7 (i.e., the switch 63 being locked in an off position). Also, the sliding member 64 is slightly flexibly deformed to store an elastic force. Further, the sliding member 64 is compressed to store an elastic force. To the contrary, the sliding member 64 can be pushed back to its position of FIG. 7 due to the release of the elastic force of the sliding member 64 and thus the disengagement of the shoulders 641 from the tunnel 633 when the cap 30 is removed as shown in FIG. 8 (i.e., the switch 63 being unlocked to be ready to move to an on position).

The externally extending annular flange 262 is fastened at the opening of the cup 41. The internally extending annular flange 263 is spaced from the protrusion 252, the passage 261 is blocked by the plunger 25, and the torsion spring 27 is compressed when the cap 30 is put on the cup 41 (see FIG. 3). To the contrary, in response to removing the cap 30 in a dispensing operation the stored elastic force of the torsion spring 27 is released to push the plunger 25 outward until the protrusion 252 is stopped by the internally extending annular flange 263 (see FIG. 4). Also, the passage 261 is no more blocked by the plunger 25 so that liquid stored in the reservoir 11 can flow to the channel 24 via the passageway 423 and the passage 261. And in turn, a user may rotate the ball 23 which picks up liquid in the channel 24 and applies same to the body area on which the ball 23 is rolled.

Figure 8:
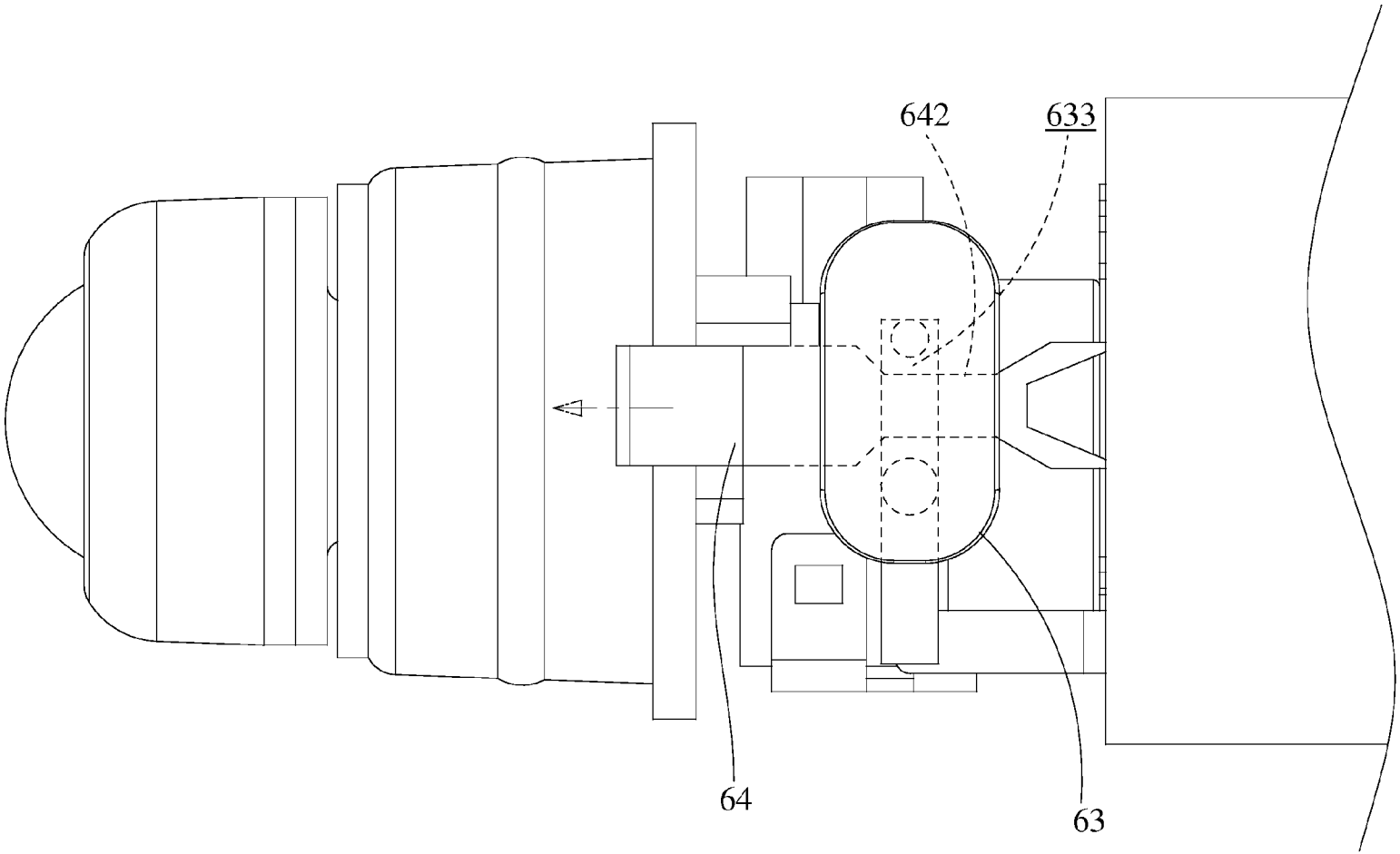
FIG. 8 is a view similar to FIG. 7 showing the switch being unlocked in a ready to turn on position.

Further, after removing the cap 30 the stored elastic force of the sliding member 64 is released to push back to its position of FIG. 8 with the shoulders 641 disengaged from the tunnel 633, i.e., the sliding member 64 being free (see FIG. 8). Thus, a user may push the knurled member 632 and thus the base member 631 so that the base member 631 may urge the first contact 61 against the second contact 62 (i.e., contacting). That is, the switch 63 is disposed from an off position to an on position by moving as indicated by arrow in FIG. 10. Note that the first contact 61 is electrically connected to the negative terminal of the battery 52 and the second contact 62 is electrically connected to the negative terminal of the DC motor 5. As such, power of the battery 52 may be supplied to the DC motor 51 for activation. The activated DC motor 51 can vibrate while the user rubs the skin by the dispensed liquid. As a result, a massage effect to the user is brought about.

Figure 9:
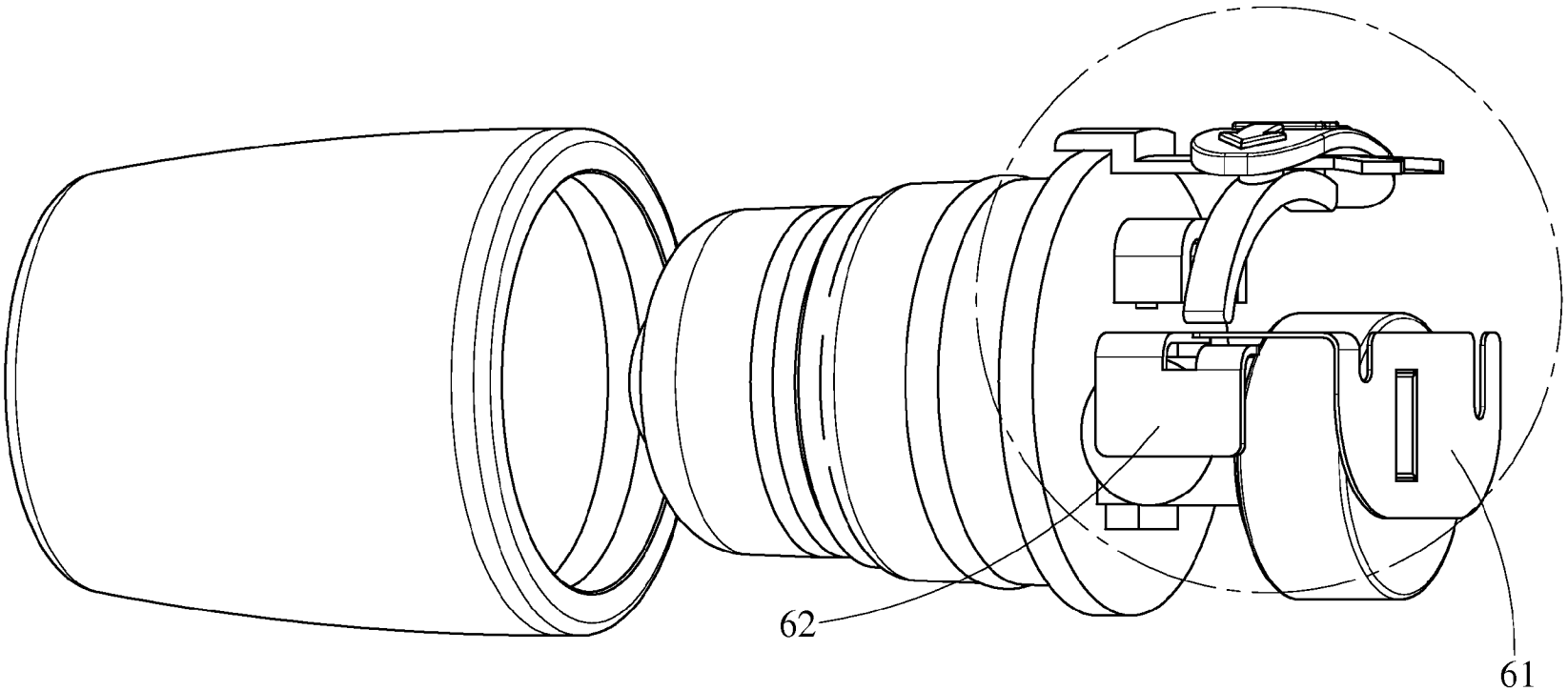
FIG. 9 is a perspective exploded view showing the switch being in an off position due to disengagement of the first contact from the second contact.
Figure 10:
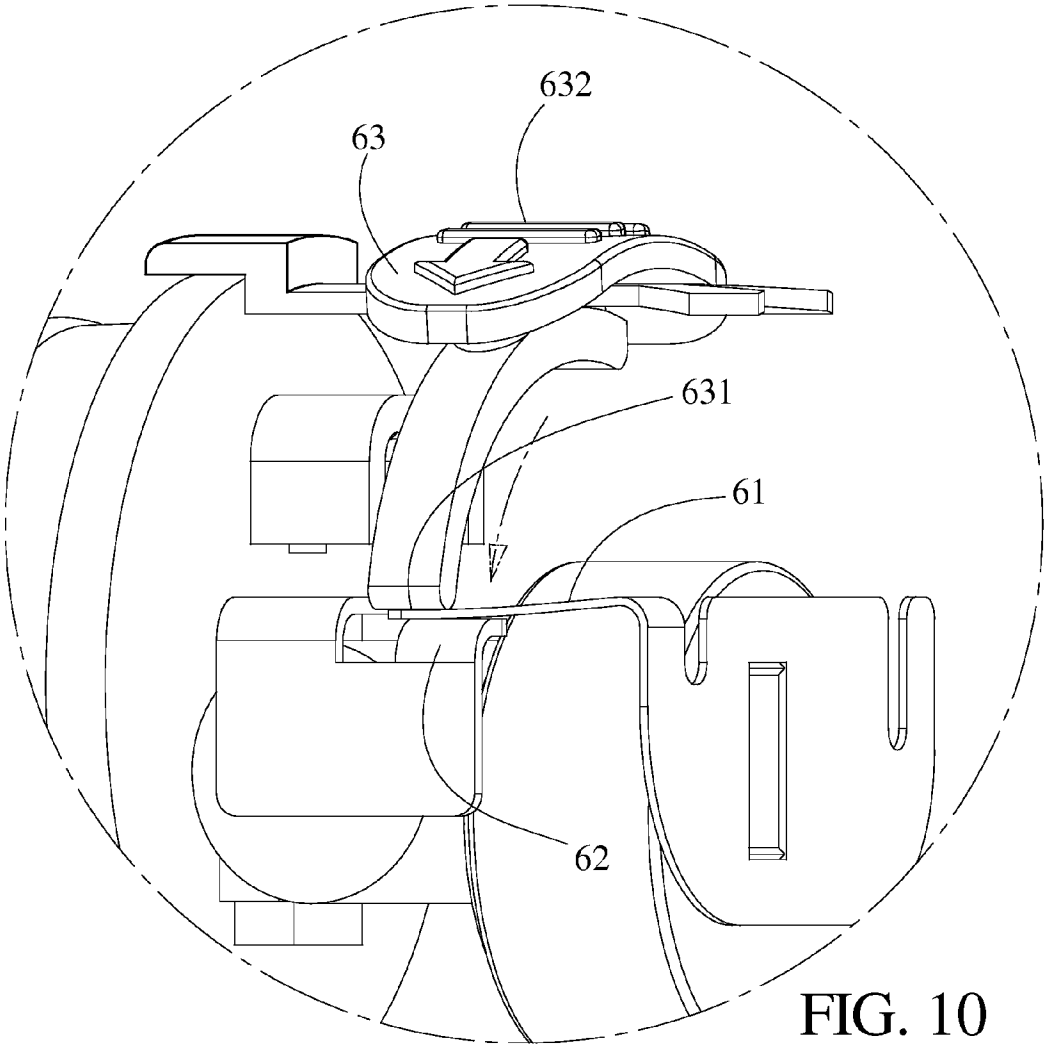
FIG. 10 is a detailed view of the area in FIG. 9 showing the switch being in an on position due to the engagement of the first contact with the second contact by manually moving the switch in a direction as indicated by arrow.

To the contrary, after putting the cap 30 on the cup 41, the sliding member 64 (i.e., stop section 643) is pushed by the cap 30 to lockingly engage the shoulders 641 with the tunnel 633. That is, the switch 63 is locked in the off position. Also, the first contact 61 is disengaged from the second contact 62. Thus, an electrical connection of the battery 52 and the DC motor 51 is cut as shown in FIGS. 7 and 9 (i.e., circuit open). Therefore, the switch 63 is prevented from inadvertent movement, for example, by the hand to close the circuit. This can prevent the battery 52 from supplying electric current to the DC motor 51 for vibration. This is a safe mechanism of the liquid dispensing massage device as envisioned by the invention.

While the invention has been described in terms of preferred embodiments, those skilled in the art will recognize that the invention can be practiced with modifications within the spirit and scope of the appended claims.

What is claimed is:

1. A liquid dispensing massage device comprising:

a container for containing a quantity of liquid and including an externally threaded neck;

a dispensing assembly comprising a retaining ring, a seal, a rotatable liquid dispensing outlet, a hollow sliding plunger defining an axial channel therethrough, the plunger including an annular protrusion on an outer surface proximate one end, the plunger being secured to the retaining ring together, a sleeve put on a portion of the plunger and including a passage at one end distal the liquid dispensing outlet, an externally extending annular flange at the other end, an internally extending annular flange adjacent the externally extending annular flange, and a space defined between and by the sleeve and the protrusion, and a biasing member put on the plunger and disposed in the space to urge against both the plunger and the sleeve toward opposite directions;

a cap comprising an annular projection on an inner surface adjacent its opening, and a peg on the underside of its top wherein the dispensing assembly is covered by the cap and the peg is engaged with the liquid dispensing outlet when the liquid dispensing massage device is closed;

a vibration shell assembly comprising a cup with the sleeve fastened therein and around an opening of the cup, a cylindrical shell, and a curved cover wherein the cup includes a disc-shaped base at one end fixedly secured to the other end of the shell, and the shell includes internal threads proximate one end, the internal threads being capable of threadedly securing to the externally threaded neck for fastening the shell and the container together, a circumferential opening with the cover complimentarily hingedly disposed thereon, and a passageway so that the liquid in the container is capable of flowing to the space via the passageway and the passage;

a vibration assembly disposed in the shell and comprising a DC (direct current) motor, a battery, a motor seat with the DC motor mounted thereon, and a battery seat wherein the DC motor is electrically connected to the battery seat; and a switch assembly comprising a first contact electrically connected to the battery, a second contact electrically connected to the DC motor, a switch including a curved base member, an outer knurled member spaced from the base member, and a tunnel defined by and between the base member and the knurled member, and an elongated sliding member slidably disposed through the tunnel and including two inclined shoulders, a narrow activation section proximate one end, and a stop section at the other end, wherein in a closed position of the liquid dispensing massage device, the cap is put on the cup, the shoulders are lockingly engaged with the tunnel to fasten both the sliding member and the switch, the biasing member is compressed to store an elastic force, the passage is blocked by the plunger, the switch is in a locked, off position, and the first contact is disengaged from the second contact to electrically disconnect the battery from the DC motor; and wherein in an open position of the liquid dispensing massage device, the cap is detached from the cup the shoulders are disengaged from the tunnel to unfasten both the sliding member and the switch, the biasing member is expanded to release the stored elastic force to push the protrusion until the protrusion is stopped by the internally extending annular flange adjacent, the passage is not blocked by the plunger, and the switch is in a moveable position so that a manual movement of the switch causes the base member to press the first contact which in turn engages with the second contact to electrically connect the battery to the DC motor.

2. The liquid dispensing massage device of claim 1, wherein the plunger further comprises an annular groove on the outer surface, the groove being proximate the other end of the plunger with the seal seated therein.

3. The liquid dispensing massage device of claim 2, wherein the seal is an O-ring.

4. The liquid dispensing massage device of claim 1, wherein the liquid dispensing outlet is rotatably disposed in an opening of the retaining ring and supported by the plunger.

5. The liquid dispensing massage device of claim 4, wherein the liquid dispensing outlet is a ball.

6. The liquid dispensing massage device of claim 1, wherein the cup further comprises an annular riser on an outer surface, the riser being complimentarily retained by the projection to lockingly secure the cup to the cap when the cap is put on the cup.

7. The liquid dispensing massage device of claim 1, wherein the battery is mounted on the battery seat.

8. The liquid dispensing massage device of claim 1, further comprising an eccentric block being rotatably driven by the DC motor for generating vibration.

* * * * *